US011702112B2

(12) United States Patent
Rayaprolu

(10) Patent No.: US 11,702,112 B2
(45) Date of Patent: Jul. 18, 2023

(54) SYSTEM FOR PROPELLING A LEVITATED TRAIN

(71) Applicant: Kittappa Rayaprolu, Hyderabad (IN)

(72) Inventor: Kittappa Rayaprolu, Hyderabad (IN)

(73) Assignee: Kittappa Rayaprolu, Telangana (IN)

( * ) Notice: Subject to any disclaimer, the term of this patent is extended or adjusted under 35 U.S.C. 154(b) by 330 days.

(21) Appl. No.: 15/733,756

(22) PCT Filed: Apr. 25, 2019

(86) PCT No.: PCT/IB2019/053414

§ 371 (c)(1),
(2) Date: Oct. 19, 2020

(87) PCT Pub. No.: WO2019/207519

PCT Pub. Date: Oct. 31, 2019

(65) Prior Publication Data

US 2021/0129872 A1 May 6, 2021

(30) Foreign Application Priority Data

Apr. 26, 2018 (IN) ..... 201841015813

(51) Int. Cl.
*B61C 3/00* (2006.01)
*B61B 13/08* (2006.01)
(Continued)

(52) U.S. Cl.
CPC ..... *B61C 3/00* (2013.01); *B61B 13/08* (2013.01); *B61C 11/00* (2013.01); *B61B 13/04* (2013.01); *B61C 9/38* (2013.01)

(58) Field of Classification Search
CPC .. B61C 3/00; B61C 9/38; B61C 11/00; B61C 11/04; B61B 13/08; B61B 13/125; B61B 13/04
See application file for complete search history.

(56) References Cited

U.S. PATENT DOCUMENTS 2,229,015 A * 1/1941 King ..... B61C 13/04 105/154
3,164,103 A * 1/1965 Lathers ..... B60V 3/04 180/125

(Continued)

FOREIGN PATENT DOCUMENTS

CN 2758311 2/2006
CN 102463966 B 9/2014

(Continued)

OTHER PUBLICATIONS

WO Search Report dated Aug. 8, 2019.

*Primary Examiner* — S. Joseph Morano
*Assistant Examiner* — James William Jones

(57) ABSTRACT

A levitated train is propelled by a system including at least a pair of wheels in cotact with a rail head. The rail head has a horizontal top surface and two vertical sides on either side of the horizontal top surface. A wheel of each wheel assembly has a cylindrical side face with flanges at the top and bottom. The cylindrical face of each of the wheels is in contact with the sides of the rail. The wheel assembly is power driven by a corresponding motor to impart motion to the train. The train is provided with a plurality of such wheel assemblies to be propelled along a rail track. The width of the wheels is greater than the width of the rail head. The flanges on the side of the wheels in a wheel assembly limit the freedom of motion of the train during the levitation.

10 Claims, 3 Drawing Sheets

(51) Int. Cl.

| | |
|---|---|
| ***B61C 11/00*** | (2006.01) |
| *B61C 9/38* | (2006.01) |
| *B61B 13/04* | (2006.01) |

(56) References Cited

U.S. PATENT DOCUMENTS

| | | | | | |
|---|---|---|---|---|---|
| 3,563,179 | A * | 2/1971 | Gorjanc | B61C 13/04 | 105/155 |
| 3,626,857 | A | 12/1971 | Omar | | |
| 3,886,869 | A * | 6/1975 | Tantlinger | B61C 11/00 | 104/287 |
| 4,995,320 | A * | 2/1991 | Sato | B61B 13/04 | 104/118 |
| 9,085,305 | B2 * | 7/2015 | Pumpelly | B61C 13/00 | |
| 2006/0219128 | A1 | 10/2006 | Li | | |

FOREIGN PATENT DOCUMENTS

| | | | | |
|---|---|---|---|---|
| EP | 600562 | A1 * | 6/1994 | B61B 13/02 |
| WO | WO2014199392 | A1 | 12/2014 | |
| WO | WO-2017162144 | A1 * | 9/2017 | |

* cited by examiner

SYSTEM FOR PROPELLING A LEVITATED TRAIN

EARLIEST PRIORITY DATE

This application claims the benefit of Provisional Patent Application bearing application no. 201841015813, filed on Apr. 26, 2018 in India.

TECHNICAL FIELD

Embodiments of the present disclosure relates to a system of levitated trains and more particularly to, a system for propelling a levitated train.

BACKGROUND

Transportation is an essential activity of human life. Over the centuries people have innovated various forms of transport starting from invention of the wheel. In the last few centuries, transport has been largely mechanized, shifting the source of power from animal to machines. With increasing world population and increasing transportation needs, there is a large negative effect on the resources and environment. Yet Railways and road transport continue to be the main inland means of transport for goods as well as human passengers. From the inception of these technologies for both road and rail transport, several ingenious improvements continue to be made almost reaching the ultimate limit imposed by the natural laws of physics.

In conventional trains, the weight of the train is borne by the wheels, wherein the pressure of the weight is applied at a contact point between the wheels and the rails, thereby offering high coefficient of friction, thereby propelling the train. However, in levitated trains, the weight of the train is supported by magnetic fields or air cushion or the likes. The conventional way of propelling a levitated train forward is by using linear electric motors or air screws and the likes. However, the installation of linear electric motors along the length of the rail is very expensive and difficult as well as costly to maintain.

Therefore, there is a need for an efficient system by which a levitated train could be propelled, wherein the system is simple and easy to put into practice.

BRIEF DESCRIPTION

In accordance with an embodiment of the present disclosure, a system for propelling a levitated train is provided. The system includes a pair of wheel assembly adapted to be received onto a rail head of a rail. The rail head comprises of a horizontal surface and two vertical sides which are parallel to each other, i.e., a first side and a second side. Further, each wheel assembly comprises of a wheel, shaft and a motor. The wheel is configured to be placed horizontally to the railhead. The wheel comprises of a first flange, a second flange and a wheel face, where the wheel face is adapted to be in contact with the first side of the rail head and the motor comprises of a first end and a second end. The first end of the motor is adapted to be connected to one side of the train and the second end is adapted to be connected vertically to the wheel via the shaft. Further, the wheel in each wheel assembly is configured to be rotated, by the motor, in the opposite direction, thereby propelling the levitated train.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which.

Figure 1:
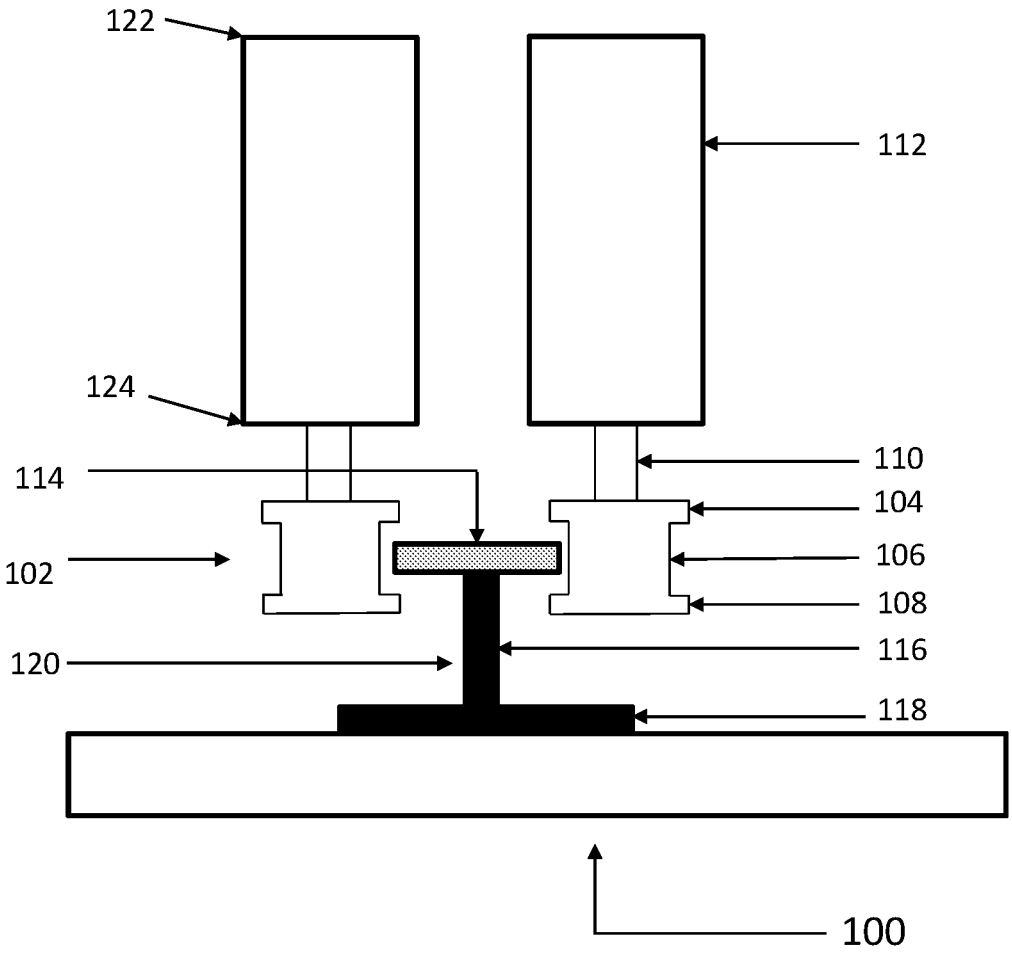
FIG. 1 illustrates a system for propelling a levitated train in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated system, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or sub-systems or elements or structures or components preceded by "comprises . . . a" does not, without more constraints, preclude the existence of other devices, sub-systems, elements, structures, components, additional devices, additional sub-systems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relates to a system for propelling a levitated train. The system (100) includes a pair of wheel assemblies, wherein each wheel assembly comprises of a wheel (102), a motor (112) and a shaft (110). Further, the wheel (102) comprises of a first flange (104), a second flange (108) and a wheel face (106). The motor comprises of a first end (122) and a second end (124), wherein the second end (124) is configured to connect to the shaft (110), wherein the shaft (110) is configured to further connect to the wheel (102). The wheel (102) is adapted to be received on to a rail head (114), wherein the wheel (102) is configured to be placed horizontally to the rail head (114).

Further, the rail head comprises a first side and a second side, wherein the wheel assembly is adapted to be placed on either side of the rail head (114), i.e., one-wheel assembly on the first side and one wheel assembly on the second side of the rail head. The rail head (114) is adapted to be received between the first flange (104) and the second flange (108), wherein the side of the rail head (114) is configured to be in contact with the wheel face (106) of the wheel (102). The width of the wheel (102) (i.e. the wheel face 106) is greater than the width of the rail head (114). The ratio of the width of the rail head to the width of the wheel is predetermined. Therefore, due to differences in width of the wheel face and rail head, the wheel face has space to move up and down on the rail thereby accommodating the variations in the levitating height. This is necessary as when the train is in motion, the dynamic external forces cause variations in the levitating height. Moreover, the first flange and the second flange limit the variation in the levitation. Thus in the event of extreme conditions, the design of the wheel and flanges prevent derailment of the train or even tilting of the train beyond safe limits.

The motor (112) is connected vertically to the train and to the wheel (102) via the shaft (110). The motor (112) is configured to receive electric power. The motor (112), on receiving the electric power, is configured to transfer rotational force to the wheels (102) via the shaft (110). The wheels (102) of each wheel assembly are configured to rotate in the opposite direction i.e., one wheel of the pair of wheel assemblies rotates in clock-wise direction and another wheel of the pair of wheel assemblies rotates in the anti clock-wise direction. The rotation of wheels in opposite directions propels a levitated train. Further, the direction of rotation of wheel may be changed to rotate in a opposite direction, i.e., a wheel rotating in clock-wise direction may be rotated in anti-clock-wise direction, and vice versa. This enables forward or backward propulsion of the levitated train as per the requirement.

In addition, the rail 120 comprises a rail head (114), a web (116) and a base (118). The web (116) connects the rail head (114) to the base (118), wherein the base (118) is affixed to ground. The wheel (102) and the base (118) are positioned at a pre-determined distance.

Figure 2:
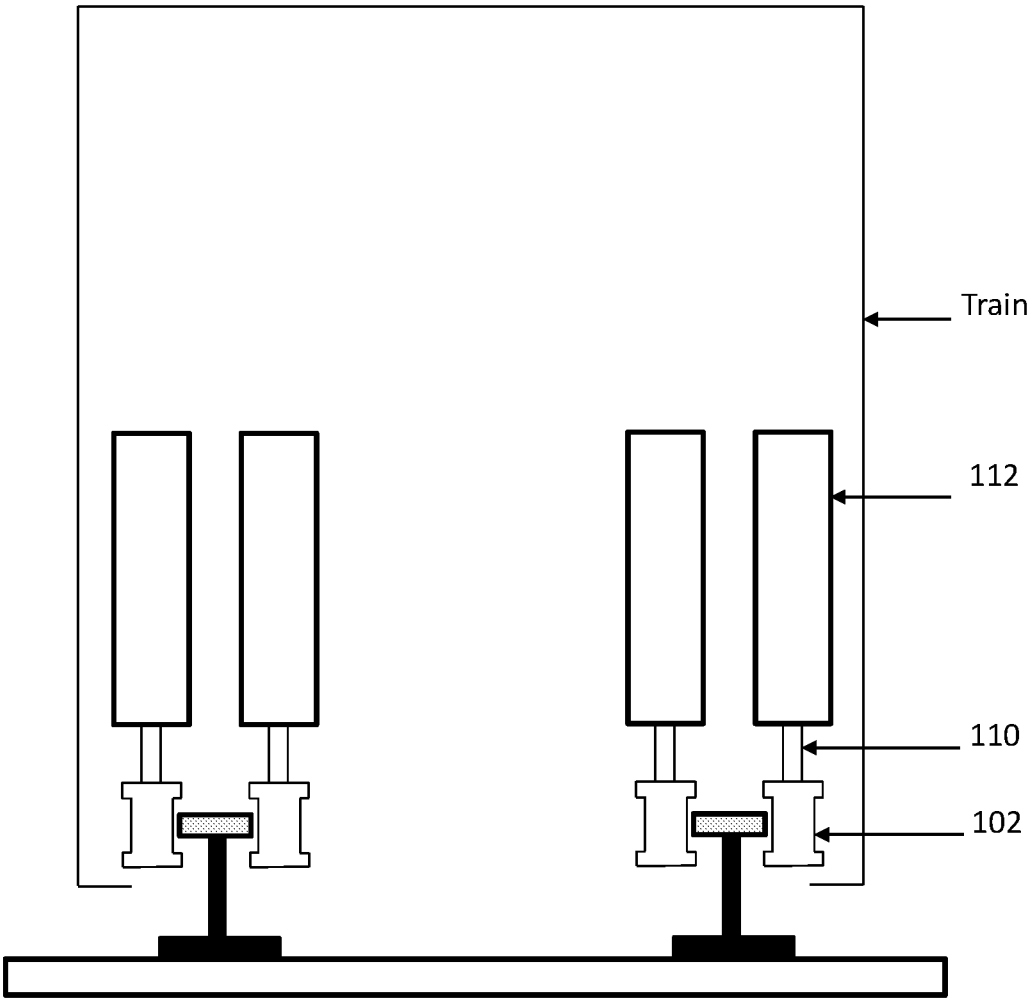
FIG. 2 illustrates a front view arrangement of a system for propelling a levitated train in accordance with an embodiment of the present disclosure.

FIG. 2 illustrates a front view arrangement of a system (100) for propelling a levitated train in accordance with FIG. 1. The system (100) is adapted to be fitted on the rail heads of parallel running rails. One or more pairs of wheel assemblies are adapted to be fitted on either side of the rail head. The levitated train is configured to receive the system (100) at the base of the train, wherein the coach of the levitated train is in contact with the motors of the wheel assemblies.

Figure 3:
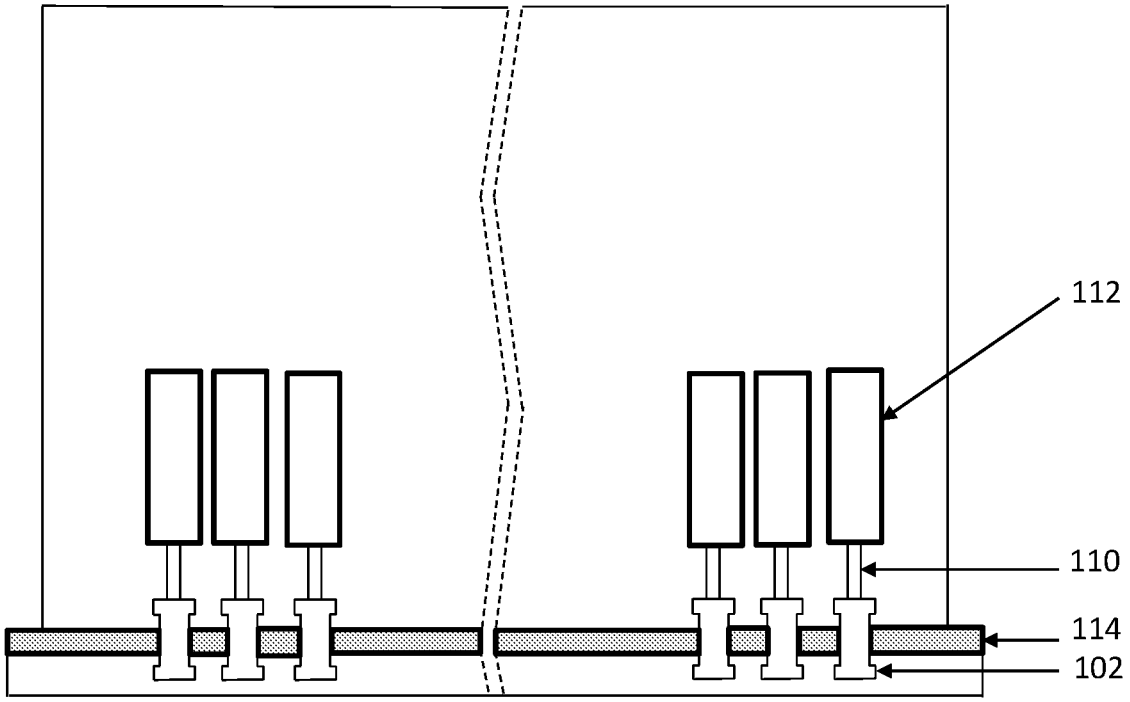
FIG. 3 illustrates a side view arrangement of a system for propelling a levitated train in accordance with an embodiment of the present disclosure.

FIG. 3 illustrates a side view arrangement of a system for propelling a levitated train in accordance with FIGS. 1 and 2. In the side view of the arrangement shown in FIG. 3, each of the front and rear portions of a coach of the levitated train is provided with a plurality of pairs of wheel assemblies (100). It is to be understood that the number of pair of wheel assemblies (100) would vary as per the requirement. In one embodiment, the middle portion of the coach of the levitated train may also be provided with plurality of pairs of wheel assemblies (100). Therefore, the positioning of the plurality of pairs of wheel assemblies (100) below the train body may vary depending on at least one of length and weight carrying capacity of the coach.

The present invention has several advantages over the conventional systems such as the system drive is mechanical and hence does not require continuous electrical magnets and windings all along the rail track. This greatly reduces the cost of installation and operation. Further, the technology for manufacturing and maintenance is relatively simpler. Moreover, the design of the wheel not only reduces the chances of slipping of train on the rail but also reduces tilting of coach of the train, therefore comparatively less damage is caused to rails, resulting in a longer life. This way of implementation results in low cost and reduced overall height of the of the train, thereby increasing stability and resulting in higher speeds compared to the advanced systems of TGV and MAG-LEV trains. Further, multiple electric motors can be used in sharing the power needed to drive the train instead of one or two large motors. Replacement of motors or maintenance can be phased out one after another.

It will be understood by those skilled in the art that the foregoing general description and the following detailed description are exemplary and explanatory of the disclosure and are not intended to be restrictive thereof.

While specific language has been used to describe the disclosure, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

We claim:

1. A system (100) for propelling a levitated train, the system (100) comprising:

a pair of wheel assemblies adapted to be received onto a rail head (114) of a rail (120), wherein the rail head (114) comprises of a first side and a second side;

each wheel assembly of the pair of wheel assemblies comprises;

a wheel (102) configured to be positioned horizontally to the rail head (114), wherein the wheel (102) comprises of a first flange (104), a second flange (108) and a wheel face (106), wherein the wheel face (106) is adapted to be in contact with the first side of the rail head (114); and a motor (112) comprised of a first end (122) and a second end (124), wherein the first end (122) is adapted to be connected to a bottom of the train and the second end (122) is adapted to be connected vertically to the wheel (102) via a shaft (110), wherein the wheel assembly is configured to be placed on a corresponding one of the first side and the second side of the rail head (114) such that the corresponding side of the rail head (114) is configured to be positioned in between the first flange (104) and the second flange 108 of the wheel of the wheel assembly, and a width of the wheel face (106) of the wheel (102) is greater than a width of the corresponding side of the rail head (114) in contact with the wheel face (106) such that the wheel (102) has space to move vertically up and down on the rail (120) while maintaining contact with the corresponding side of the rail head (114), and wherein the first flange (104) and the second flange (108) limit variation in levitation of the levitated train, and wherein the wheel (102) in each wheel assembly is configured to be rotated, by the motor (112), thereby propelling the levitated train.

2. The system (100) as claimed in claim 1, wherein the motor (12) is configured to receive electric power to rotate wheels of the pair of wheel assemblies.

3. The system (100) as claimed in claim 1, wherein the wheel (102) width is greater than the width of the rail head (114).

4. The system (100) as claimed in claim 1, wherein the motor (112) is configured to transfer rotational force to the wheel (102).

5. The system (100) as claimed in claim 1, wherein the motor (112) is configured to change direction of rotation of the wheel (102).

6. The system (100) as claimed in claim 1, wherein the motors included in each of the pair of wheel assemblies are configured to rotate the wheel of a corresponding wheel assembly in a direction opposite to that of another corresponding wheel assembly of the pair of wheel assemblies.

7. A system for propelling a levitated train, the system comprising:

at least one pair of wheel assemblies adapted to be received onto a rail head of a rail, wherein the rail head comprises of a first side and a second side;

each wheel assembly of the at least one pair of wheel assemblies comprises:

a wheel to be positioned horizontally to the rail head, wherein the wheel comprises of a first flange, a second flange and a wheel face, wherein the wheel face (106) is adapted to be in contact with the first side of the rail head; and a motor comprised of a first end and a second end, wherein the first end is adapted to be connected to a bottom of the train and the second end is adapted to be connected vertically to the wheel via a shaft, wherein the wheel assembly is configured to be placed on a corresponding one of the first side and the second side of the rail head such that the corresponding side of the rail head is configured to be positioned in between the first flange and the second flange of the wheel of the wheel assembly, and a width of the wheel face of the wheel is greater than a width of the corresponding side of the rail head in contact with the wheel face such that the wheel has space to move vertically up and down on the rail while maintaining contact with the corresponding side of the rail head, and wherein the first flange and the second flange limit variation in levitation of the levitated train, and wherein the wheel in each wheel assembly is configured to be rotated, by the motor, thereby propelling the levitated train.

8. The system as claimed in claim 7, wherein the at least one pair of wheel assemblies comprises multiple pairs of wheel assemblies with corresponding multiple electric motors.

9. The system as claimed in claim 8, wherein the multiple electric motors share power needed to drive the levitated train.

10. The system as claimed in claim 8 wherein the multiple pairs of wheel assemblies are configured to engage a pair of parallel rails.

* * * * *